US005511287A

United States Patent [19]

Lautenschläger et al.

[11] Patent Number: 5,511,287

[45] Date of Patent: Apr. 30, 1996

[54] FURNITURE HINGE

[75] Inventors: Horst Lautenschläger, Reinheim; Gerhard W. Lautenschläger, Wersau, both of Germany

[73] Assignee: MEPLA-Werke Lautenschläger GmbH & Co. KG, Germany

[21] Appl. No.: 342,145

[22] Filed: Nov. 18, 1994

[30] Foreign Application Priority Data

Dec. 15, 1993 [DE] Germany ..... 43 42 744.8

[51] Int. Cl.[6] ..... E05D 7/06; E05D 7/04

[52] U.S. Cl. ..... 16/239; 16/238; 16/236; 16/DIG. 43

[58] Field of Search ..... 16/238, 237, 236, 16/239, DIG. 43

[56] References Cited

U.S. PATENT DOCUMENTS

| | | | |
|---|---|---|---|
| 3,890,670 | 6/1975 | Sewing et al. | 16/236 |
| 4,800,625 | 1/1989 | Salice | 16/237 |
| 5,105,506 | 4/1992 | Lin | 16/DIG. 43 |
| 5,295,282 | 3/1994 | Lautenschlager | 16/237 |

FOREIGN PATENT DOCUMENTS

| | | | |
|---|---|---|---|
| 373969 | 3/1984 | Austria . | |
| 1554336 | 10/1971 | Germany . | |
| 2614446 | 10/1976 | Germany . | |
| 2601809 | 7/1977 | Germany | 16/237 |
| 2819100 | 11/1978 | Germany . | |
| 353132 | 10/1979 | Germany . | |
| 3301279 | 7/1984 | Germany . | |
| 3320868 | 12/1984 | Germany . | |
| 3516911 | 11/1986 | Germany . | |
| 4211722 | 10/1993 | Germany . | |

*Primary Examiner*—Maurina T. Rachuba
*Assistant Examiner*—Adesh Bhargava

[57] ABSTRACT

The present invention relates to a furniture hinge having a wall-related part shaped as an elongated supporting arm which can be mounted for adjustment in at least two coordinate directions on an associated mounting plate disposed on the wall of a cabinet carcase. The supporting arm is mounted and fastened on the mounting plate by a mounting screw driven into the mounting plate and passing through a slot provided at the inside end with an enlarged pass-through opening in the web of the supporting arm. A threaded spindle is screwed in a tap in the web of the supporting arm, which is situated further out from the carcase interior than the slot. At the bottom end of the spindle, on a neck of smaller diameter, is a head of larger diameter. This head is inserted into an open-ended slot provided in the mounting plate, which clutches the sides of the head, securing it against lifting away from the mounting plate.

8 Claims, 2 Drawing Sheets

FURNITURE HINGE

BACKGROUND OF THE INVENTION

1. Field of the Invention

The invention relates to a cabinet hinge with a supporting-wall-related part in the form of an elongated sheet-metal supporting arm of essentially channel-shaped cross section coupled by a link to the door-related part. The arm is mounted releasably and adjustably on a mounting plate fastened to the wall of a cabinet carcase. The supporting arm's flanges are at least partially astride the mounting plate, and its web has at its cabinet-interior end an elongated opening through which a screw is driven into the mounting plate and a tap is provided in the web in which a threaded spindle is contained at the bottom end of which a holding head of increased diameter connected to the spindle by a neck of lesser diameter is inserted into an open-ended slot provided in the mounting plate. The holding head is thus secured against lifting away from the mounting plate.

2. The Prior Art

In modern furniture manufacture articulated hinges of this kind, especially four-joint hinges, have come into widespread use for hanging doors on cabinets (German Pat. 2 614 446). The hinges are installed on mounting plates previously mounted on the cabinet, while the cabinet-related hinge part, in the form of an elongated supporting arm, can be fastened to it for adjustment in at least two coordinate directions. The rapid and simple mounting and dismounting as well as the said adjustments in two coordinate directions in the modern hinges of the kind here in question are made possible by the fact that the supporting arm is clamped on the mounting plate at a desired relative lengthwise setting by a screw driven into the mounting plate and passing through a slot open at the carcase-interior end. This lengthwise adjustment makes it possible, for example, to adjust an overlapping or lipped door with respect to the gap existing, when it is closed, between its inside surface and the edge of the carcase walls. Also necessary is a second, horizontal adjustment at right angles to the above-mentioned lengthwise adjustment, to permit varying the degree of overlap of the door with respect to the edge of the carcase. This adjustment is made in the hinges of the kind described above by means of a threaded spindle driven into a tap in the web of the supporting arm, the spindle having at its inside end, i.e., the mounting plate end, a holding head of enlarged diameter connected to it by a neck section of smaller diameter. This holding head is inserted into an open-ended slot or cut-out in the mounting plate, and is engaged by the laterally projecting edges of the slot. It is clear that by turning the threaded spindle of the supporting arm further in or further out the supporting arm will be pushed away from the mounting plate or drawn closer to it. Thus, when the spindle is rotated the supporting arm will be raised or lowered, since the spindle is disposed at a distance ahead of the point further inside of the carcase where the supporting arm is supported and fastened on the mounting plate and thus it is fulcrumed at that point. On account of the arcuate raising and lowering movement of the supporting arm during adjustment the attitude of the axis of rotation of the threaded spindle will likewise change, though but slightly. This, however, also signifies that the neck between the holding head and the bottom of the threaded spindle, in which the edges of the slot are engaged, has to be made somewhat longer than the thickness of the edges engaged in this gap, since otherwise no change in the angle of the threaded spindle would be possible, and if a change of the overlap were to be attempted by turning the threaded spindle in or out the spindle would jam in the slot. Due to the existing clearance the supporting arm is thus exclusively held by the screw tightening it onto the mounting plate. Since this screw is provided at the inside end of the supporting arm and mounting plate, the outside end of the supporting arm is at a relatively great distance from the point at which it is fastened, i.e., the stresses which the door applies through the hinge mechanism produce a relatively high bending moment in the front part of the supporting arm, which might also lead to the deformation of the supporting arm to the extent of the clearance between the holding head and the mounting plate. In the case of the supporting arms stamped from sheet metal which are nowadays increasingly used, such deformations are within the uncritical elastic range of the material, but a door hung on a cabinet with such hinges has a certain instability, which is not desired.

SUMMARY OF THE INVENTION

It is therefore a principle object of the invention to address the problem of improving the known hinges such that a door can be hung without free play on such hinges without losing the possibility of adjusting the supporting arm on the mounting plate.

Setting out from a cabinet hinge of the kind described above, this problem is solved in accordance with the invention by providing the elongated opening at a distance from the inner end of the supporting arm and giving it a keyhole shape, known in itself, composed of a slot with a portion of enlarged diameter for the admission of the head of the mounting screw, and by providing the tap that receives the mounting screw in a projection rising above the mounting plate toward the web of the supporting arm and having a surface in contact with the inside surface of its web. In the hinge thus configured, to change the overlap use is made of the threaded spindle that is used in the known hinge of the kind described in the beginning, but one having a holding head guided for lengthwise displacement in the mounting plate which secures the supporting arm in the selected setting both against lifting away from the mounting plate and against moving toward it, while the locking of the supporting arm at a chosen lengthwise setting is performed in an area of the supporting arm moved closer to the threaded spindle for the adjustment of the overlap than it is in the case of the known hinges mentioned above, namely in a slot terminating also at the inside end, which in the case of still older hinges (German Patent 15 54 336) has at the inner end an opening of greater diameter for the head of the mounting screw which in turn is driven into a projection protruding above the mounting plate, so that the supporting arm is locked by forcing the inside of its web against the face of the projection, the supporting arm being clamped in position by the mounting screw against the projection on the mounting plate in an area nearer the carcase interior through which the fastening screw passes. The portion of the supporting arm extending toward the exterior of the cabinet is thus cantilevered above the mounting plate. Within the range permitted by the elasticity of the sheet-metal supporting arm, therefore, the degree of overlap can be adjusted in either direction without loosening the mounting screw, simply by turning the threaded spindle. In the older known hinges, in which the variation of the overlap was performed by means of a threaded spindle thrusting against the upper side of the mounting plate, it is then necessary—at least when the overlap is to be increased—to retighten the mounting screw that has thus been loosened. This loosening of the mounting screw therefore created the risk of losing the adjustment of the supporting arm lengthwise on the mounting plate due to the weight of the door that is hung with the hinge.

In a preferred embodiment of the invention, the distance between the tap containing the threaded spindle and the mouth of the slot in the web of the supporting arm is to be approximately equal to the distance between the tap containing the mounting screw from the mouth of the slot in the mounting plate. This assures that when the supporting arm is mounted on the mounting plate, and when the head of the mounting screw is passed through the enlarged opening, the head on the spindle for adjusting the overlap will still be in front of the mouth of the slot that receives it. When the mounting screw is inserted into the mounting slot, the head will then simultaneously be engaged in its associated slot in the mounting plate.

Both on the supporting arm and on the mounting plate it is then desirable to provide, in a manner known in itself, at least one abutment and one counter-abutment which will come in contact with one another when the mounting screw is loosened and the supporting arm is slipped lengthwise on the mounting plate toward the outside of the cabinet when the shaft of the mounting screw is in the transition between the slot and its entrance. In order to pull the supporting arm further out and remove it, the mounting screw must be backed off additionally by an amount equal to the height of the cooperating abutments. That is, even when the mounting screw is loosened, assurance is provided against accidental loosening of the supporting arm from the mounting plate causing the door to fall.

To secure the supporting arm in its longitudinal setting on the mounting plate even if the mounting screw has in the course of time loosened slightly, it is recommendable to provide parallel knurls or ribs running transversely on the surfaces of the mounting plate projection and the confronting inside surface of the web of the supporting arm in the area of the slot.

BRIEF DESCRIPTION OF THE DRAWINGS

The invention is further explained in the following description of an embodiment, in conjunction with the drawing, wherein.

DETAILED DESCRIPTION OF THE DRAWINGS

Figure 1:
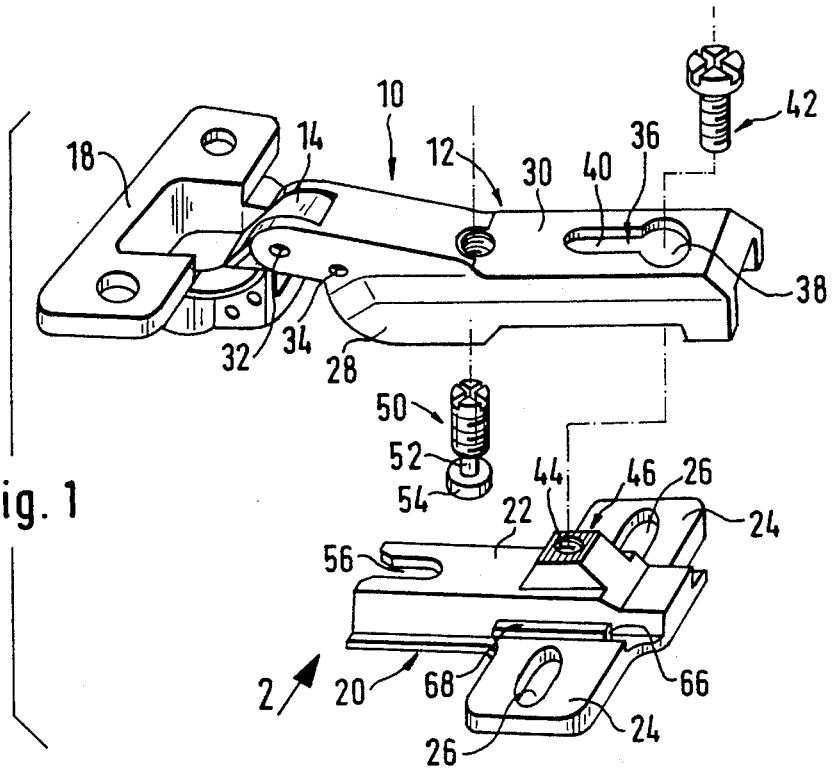
FIG. 1 is an exploded perspective view of a hinge according to the invention, with its corresponding mounting plate.
Figure 2:
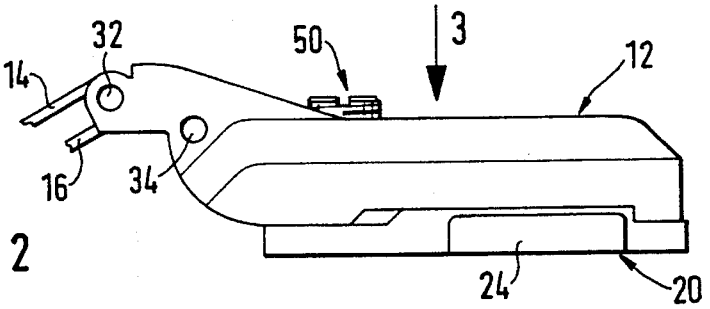
FIG. 2 a side view of the supporting arm of the hinge, seen in the direction of arrow 2 in FIG. 1.
Figure 3:
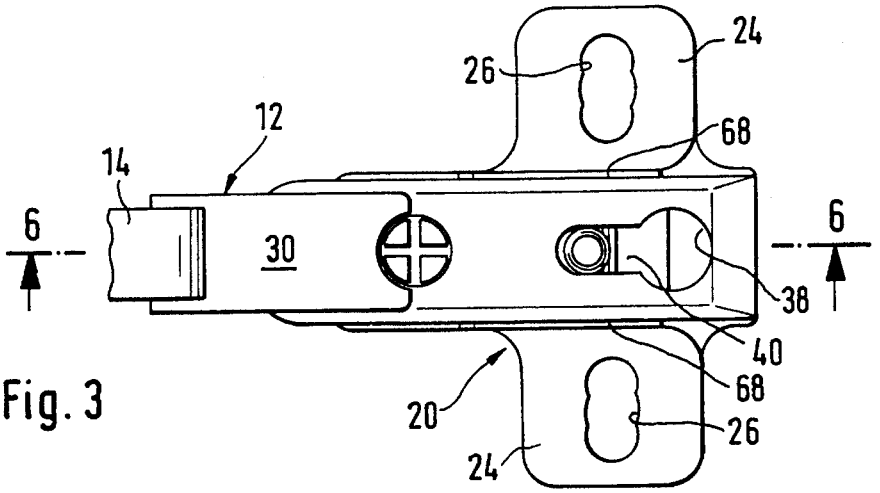
FIG. 3 a top plan view of the supporting arm seen in the direction of arrow 3 in FIG. 2.
Figure 4:
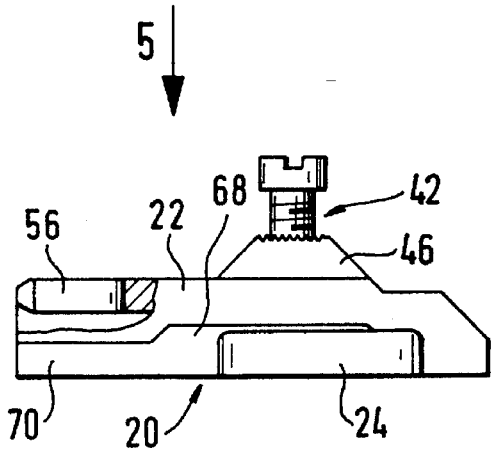
FIG. 4 a side view of the mounting plate of the hinge, seen in the direction of arrow 2 in FIG. 1.
Figure 5:
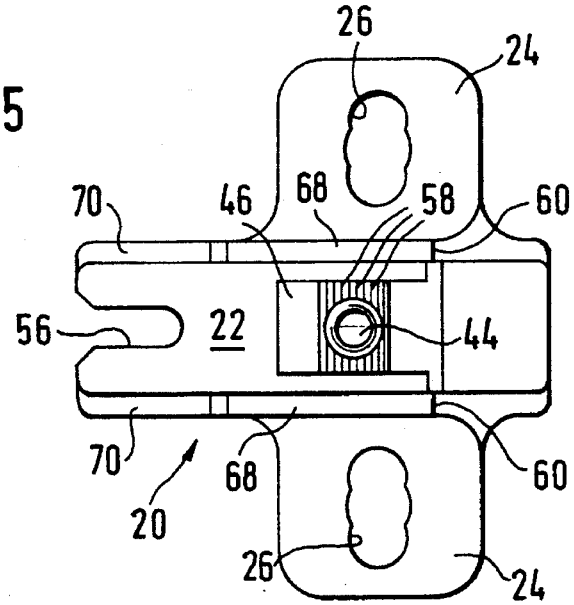
FIG. 5 a plan view of the mounting plate seen in the direction of arrow 5 in FIG. 4, and FIG. 6 a sectional view of the supporting arm taken along line 6—6 in FIG. 3.
Figure 6:
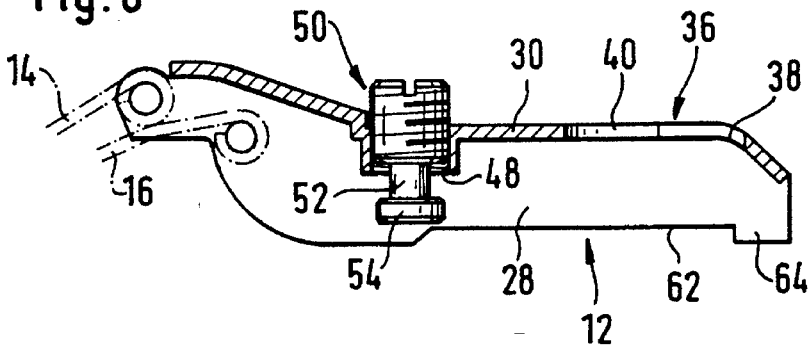

Referring now to the drawings, FIG. 1 shows a cabinet hinge identified as a whole by 10, which is a so-called four-joint hinge, whose cabinet wall-related part in the form of an elongated supporting arm 12 is coupled by a four-joint mechanism formed by two hinge links 14 and 16 to a door-related hinge part in the form of a cup 18 which can be sunk into a mortise on the back of a door.

The supporting arm 12 stamped from sheet metal can be fastened adjustably on the mounting plate 20. From opposite sides of an elongated central section 22 of the mounting plate extend flat, wing-like projections 24, each with an elongated slot 26. Mounting plates provided with such lateral fastening projections are also called "wing plates." For the invention, however, it is not essential whether the mounting plate is configured as a wing plate in the manner represented, or has the otherwise common elongated, bar-like configuration.

The supporting arm 12 has an essentially channel-shaped cross section whose parallel flanges 28 are joined along their upper margins by a web 30. In the end portion situated on the left in FIGS. 1, 2, 3 and 6, two bores 32 and 34 are provided in the flanges 28 which serve to accommodate pivot pins on which the hinge links 14 and 16 of the four-joint mechanism are journaled.

In an area on the right in the drawing, i.e., an area toward the interior of a cabinet but at a distance from the interior end of the supporting arm 12, there is provided in the web 30 a hinge-mounting slot 36 with an enlarged inside end 38; through this slot a mounting screw 42 is passed when the supporting arm is installed on the mounting plate 20. The shaft of the mounting screw 42 is driven into a tap 44 in a projection 46 rising from the upper side of the flat central section 22 of the mounting plate 20.

At a distance from the mounting slot 36 toward the link mechanism a tap 48 is provided in the web 30 into which a threaded spindle 50 is driven, at the inside end of which, between the flanges 28 of the supporting arm 29, a disk-shaped head 54 is provided which is joined to the spindle by a neck 52 of smaller diameter, so that an annular groove is formed between the actual threaded shaft of the spindle 50 and the head 54.

The mounting plate 20 has in its flat portion 22 a slot 56 open at the hinge link end, the width of which is such that the neck 52 between the head 54 and the actual threaded shaft of the spindle 50 can be fitted into it.

The mounting of the supporting arm 12 on the mounting plate 20 is performed by guiding the slot 36 over the mounting plate so that the head of the mounting screw driven into the tap 44 is in line with the enlarged portion 38. Then the supporting arm 12 is lowered against the mounting plate while the head of the mounting screw 38 passes through the enlarged portion 38. At the same time the threaded spindle 50 is brought to a position in which the neck section 52 joining the head 54 to the threaded section is just in front of the slot 56 in the flat middle section 22 of the mounting plate. Then, by pushing the hinge 10 toward the cabinet interior the shaft of the mounting screw is inserted into the straight part 40 of the slot 36, while at the same time the neck 52 of the threaded spindle is inserted into slot 56. By tightening the screw 42 so that the inside surface of the web 30 is forced against the top of the projection 46, the supporting arm 12 can then be fastened at a chosen position on the mounting plate. To secure the setting of the supporting arm transverse ribs or knurls 58 can be provided in the face of the projection 46 and in the confronting inside surface of the web 30.

Elongated narrow cut-outs 62 are provided in a portion of the margins of the flanges 28 of the supporting arm 12. Thus the width of these flanges is slightly reduced at these cut-outs 62. The margins 64 at the inner end of the cut-outs 62 form abutments for the corresponding abutments 66 which are formed on the inside end of lateral projections 68 of the flat midsection 22 of the mounting plate. The positions of the abutment surfaces 66 and 64 are selected such that they just touch one another when the shaft of the loosened mounting screw 42 is in the transition between the slot 40 and the enlarged opening 38.

The rib-like projections 68 of the midsection 22 are part of an edging 70 extending along the entire length of both sides of the mounting plate 20 and projecting upwardly into the cutouts 62 of the supporting arm 12. Therefore, when the mounting screw 42 is tightened, the supporting arm 12 can also rest at the ends of the rib-like projections 68 further inside of the cabinet from the mounting screw 42.

I do not limit myself to any particular details of construction set forth in this specification and illustrated in the accompanying drawings, as the same refers to and sets forth only certain embodiments of the invention, and it is observed that the same may be modified without departing from the spirit and scope of the invention.

Having thus described the invention, what we claim as new and desire to be secured by Letters Patent is as follows:

1. A cabinet hinge having a supporting wall-related part which is formed as an elongated sheet-metal supporting arm having a channel-shaped cross section, a hinge link coupling said supporting arm to a door-related part, a mounting plate on which said door-related part can be releasably and adjustably mounted, a cabinet carcase having a supporting wall to which the mounting plate can be fastened, the supporting arm having flanges that are at least partially astride the mounting plate and a web of the supporting arm having a cabinet-interior end having an elongated opening, a screw, having a shaft, is driven through said elongated opening into the mounting plate and a tap is provided in the web of the supporting arm in which a threaded spindle is contained at the bottom end of which, on the mounting plate side, a holding head of increased diameter connected to the spindle by a neck of lesser diameter is inserted into a slot, which has an open end facing the link mechanism and is provided in the mounting plate and which laterally clutches the holding head on the threaded spindle side, and secures it against lifting away from the mounting plate, comprising said elongated fastening opening being located at a distance from the carcase-interior end of the supporting arm and being shaped as a slot having a pass-through opening of an enlarged diameter for the head of the mounting screw, said tap receiving the shaft of the mounting screw is provided in a projection reaching from the mounting plate toward the web of the supporting arm and having an end face in contact with the inner surface of the web, and that the supporting arm, when tightened by the mounting screw against the projection, is supported on the mounting plate in an area offset toward the carcase interior with respect to the area through which the mounting screw passes.

2. The furniture hinge according to claim 1, wherein the distance between the tap containing the threaded spindle and the entry into the slot from the enlarged pass-through opening in the web of the supporting arm is approximately equal to the distance between the tap holding the mounting screw and the mouth of the slot in the mounting plate on the link mechanism end.

3. The furniture hinge according to claim 1, wherein on the supporting arm and on the mounting plate at least one cooperating abutment and counter-abutment is provided, which come into contact when the mounting screw is loosened and the supporting arm is shifted lengthwise on the mounting plate in a direction away from the carcase interior when the shaft of the mounting screw is in the area of transition from the slot toward the pass-through opening.

4. The furniture hinge according to claim 1, wherein parallel ribs or knurls are provided in the area of the slot which run transversely of the direction of lengthwise adjustment,said parallel ribs or knurls protruding from the mounting plate, and in the inside surface facing it of the web of the supporting arm.

5. The furniture hinge according to claim 2, wherein on the supporting arm and on the mounting plate at least one cooperating abutment and counter-abutment is provided, which come into contact when the mounting screw is loosened and the supporting arm is shifted lengthwise on the mounting plate in a direction away from the carcase interior when the shaft of the mounting screw is in the area of transition from the slot toward the pass-through opening.

6. The furniture hinge according to claim 2, wherein parallel ribs or knurls are provided in the area of the slot which run transversely of the direction of lengthwise adjustment,said parallel ribs or knurls protruding from the mounting plate, and in the inside surface facing it of the web of the supporting arm.

7. The furniture hinge according to claim 3, wherein parallel ribs or knurls are provided in the area of the slot which run transversely of the direction of lengthwise adjustment,said parallel ribs or knurls protruding from the mounting plate, and in the inside surface facing it of the web of the supporting arm.

8. The furniture hinge according to claim 5, wherein parallel ribs or knurls are provided in the area of the slot which run transversely of the direction of lengthwise adjustment,said parallel ribs or knurls protruding from the mounting plate, and in the inside surface facing it of the web of the supporting arm.

* * * * *